US010498086B2

(12) United States Patent
Rengarajan et al.

(10) Patent No.: US 10,498,086 B2
(45) Date of Patent: Dec. 3, 2019

(54) DIFFERENTIAL PAIR SIGNAL CONTACTS WITH SKEW CORRECTION

(71) Applicant: FCI USA LLC, Etters, PA (US)

(72) Inventors: Madhumitha Rengarajan, Mechanicsburg, PA (US); Lewis Robin Johnson, York, PA (US); Jan De Geest, Wetteren (BE)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 16/069,291

(22) PCT Filed: Jan. 12, 2017

(86) PCT No.: PCT/US2017/013093

§ 371 (c)(1),
(2) Date: Jul. 11, 2018

(87) PCT Pub. No.: WO2017/123689

PCT Pub. Date: Jul. 20, 2017

(65) Prior Publication Data

US 2019/0027869 A1 Jan. 24, 2019

Related U.S. Application Data

(60) Provisional application No. 62/277,731, filed on Jan. 12, 2016.

(51) Int. Cl.
*H01R 43/24* (2006.01)
*H01R 13/6477* (2011.01)
(Continued)

(52) U.S. Cl.
CPC ..... *H01R 13/6477* (2013.01); *H01R 13/6474* (2013.01); *H01R 43/24* (2013.01); *H01R 13/405* (2013.01); *H01R 13/6471* (2013.01)

(58) Field of Classification Search
CPC ..... H01R 13/6477; H01R 43/24; H01R 13/6474; H01R 13/405; H01R 13/6471
See application file for complete search history.

(56) References Cited

U.S. PATENT DOCUMENTS 6,293,827 B1 * 9/2001 Stokoe ..... H01R 13/514 439/108
2002/0111068 A1 8/2002 Cohen et al.
(Continued)

FOREIGN PATENT DOCUMENTS

CN 102005674 A 4/2011
CN 201956501 U 8/2011
(Continued)

OTHER PUBLICATIONS

International Search Report and Written Opinion for International Application No. PCT/US2017/013093 dated Mar. 21, 2017.
(Continued)

*Primary Examiner* — Truc T Nguyen
(74) *Attorney, Agent, or Firm* — Wolf, Greenfield & Sacks, P.C.

(57) ABSTRACT

An electrical connector configured for differential pairs with low in-pair skew. The connector may comprise lead frame assemblies, such as insert molded lead frame assemblies, with adjacent conductors configured for reduced skew by distributing skew correction throughout the transmission path through the lead frame assembly. Elongated air gaps are formed in a side of the housing, exposing the longer conductor of each pair. The elongated air gap may span the entire length of the arc of a longer conductor of each pair. The width of this air gap may be different for different pairs in the lead frame assembly and may be selected to cancel or prevent in-pair skew from arising. The width for each pair may be selected to tune the effective dielectric constant of the longer conductor such that its electrical length matches that of the shorter conductor.

19 Claims, 4 Drawing Sheets

(51) Int. Cl.

| | |
|---|---|
| ***H01R 13/6474*** | (2011.01) |
| *H01R 13/405* | (2006.01) |
| *H01R 13/6471* | (2011.01) |

(56) References Cited

U.S. PATENT DOCUMENTS

| | | | | |
|---|---|---|---|---|
| 2003/0143894 | A1* | 7/2003 | Kline | H01R 13/514 439/607.56 |
| 2005/0176307 | A1 | 8/2005 | Lang et al. | |
| 2008/0246555 | A1 | 10/2008 | Kirk et al. | |
| 2009/0093158 | A1* | 4/2009 | McAlonis | H01R 13/514 439/607.41 |
| 2010/0144167 | A1* | 6/2010 | Fedder | H01R 13/514 439/68 |
| 2010/0240233 | A1* | 9/2010 | Johnescu | H01R 13/514 439/108 |
| 2011/0009011 | A1* | 1/2011 | Johnescu | H01R 13/6477 439/701 |
| 2012/0214344 | A1* | 8/2012 | Cohen | H01R 13/6461 439/607.08 |
| 2014/0273627 | A1* | 9/2014 | Cartier, Jr. | H01R 13/658 439/607.11 |
| 2015/0236451 | A1* | 8/2015 | Cartier, Jr. | H01R 13/6585 439/607.05 |
| 2016/0093985 | A1* | 3/2016 | Zhang | H01R 13/6586 439/607.07 |
| 2016/0181732 | A1* | 6/2016 | Laurx | H01R 13/41 439/607.01 |

FOREIGN PATENT DOCUMENTS

| | | | |
|---|---|---|---|
| CN | 204304028 | U | 4/2015 |
| WO | WO 2014-152877 | A1 | 9/2014 |

OTHER PUBLICATIONS

International Preliminary Report on Patentability for International Application No. PCT/US2017/013093 dated Jul. 26, 2018.

Chinese Office Action for Application No. CN 201780006224.5 dated May 5, 2019.

* cited by examiner

DIFFERENTIAL PAIR SIGNAL CONTACTS WITH SKEW CORRECTION

CROSS-REFERENCE TO RELATED APPLICATIONS

This application is a National Phase Entry of international PCT patent application No. PCT/US2017/013093, filed Jan. 12, 2017, entitled "DIFFERENTIAL PAIR SIGNAL CONTACTS WITH SKEW CORRECTION", which claims priority to and the benefit of U.S. Provisional Application Ser. No. 62/277,731, filed Jan. 12, 2016, entitled "DIFFERENTIAL PAIR SIGNAL CONTACTS WITH SKEW CORRECTION". The entire contents of these applications are incorporated herein by reference in their entirety.

BACKGROUND

Technical Field

The exemplary and non-limiting embodiments relate generally to an electrical connector and, more particularly, to an electrical connector having differential pair signal contacts.

BRIEF DESCRIPTION OF DRAWINGS

Various aspects and embodiments will be described with reference to the following figures. It should be appreciated that the figures are not necessarily drawn to scale. Items appearing in multiple figures are indicated by the same or a similar reference number in all the figures in which they appear.

DETAILED DESCRIPTION OF EMBODIMENTS

Figure 1:
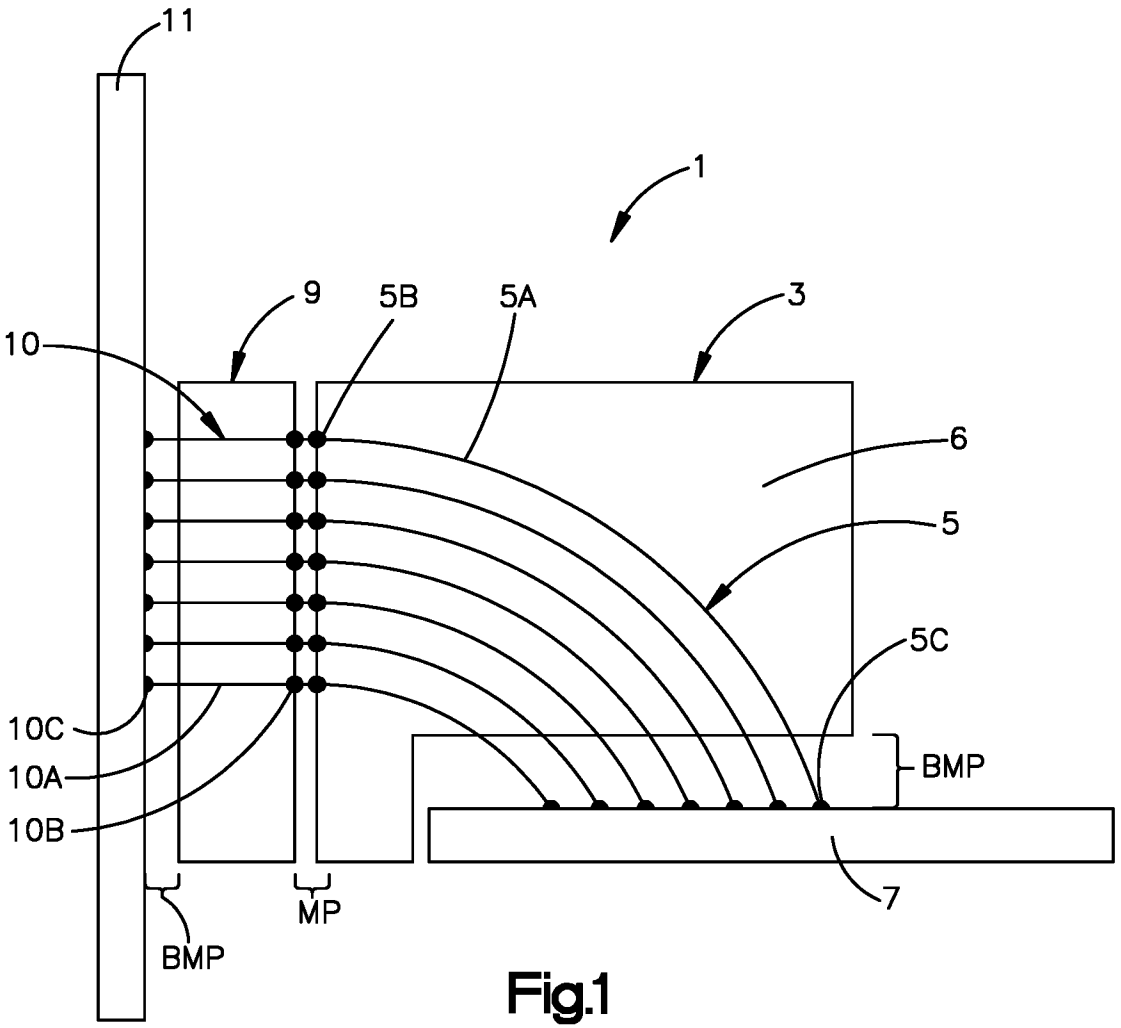
Fig.1 PRIOR ART
FIG. 1 is shown a schematic illustration of a conventional electronic assembly comprising a connector.

Referring to FIG. 1, there is shown a schematic illustration of a conventional assembly 1 comprising a connector 3. The connector 3 generally comprises a plurality of electrical leads 5 in an insulating material 6. The connector 3 is connected to a first circuit board 7 on one side and on another side to a counterconnector 9 in the form of a header 9 having leads 10. On the opposite side from the connector 3, the header 9 is connected to a second circuit board 11. All leads 5, 10 comprise a lead portion 5A, 10A, and first contact portions 5B, 10B, on one end for contacting an associated lead 10, 5 of the mated connector 9, 3 in a mating portion MP. The leads 5, 10, further comprise second contact portions 5C, 10C, on their opposite end for contacting a respective further object to be contacted, here the first and second circuit boards 7 and 11, respectively. The mating contacts 5B, 10B may be partly or fully enveloped in dielectric housing material of the connector and/or counterconnector (not shown), when mated. Board connectors 5C, 10C may be generally exposed from connector housing material in respective board mounting portions BUMP. The shown connector 3 is a right-angle connector, but the disclosure and the concepts disclosed herein are not limited to such connector and any angle including a straight mezzanine connector may be provided.

Figure 2:
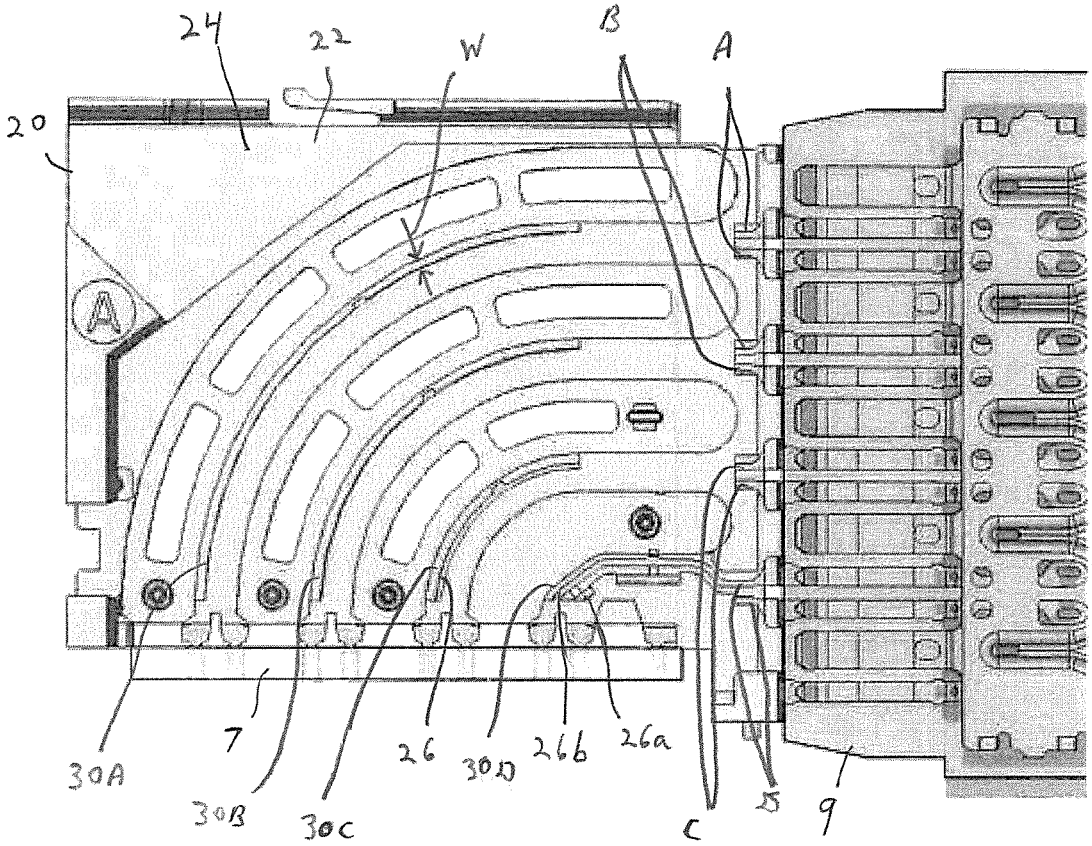
FIG. 2, is a side view of a connector incorporating features of an example embodiment.

Referring also to FIG. 2, there is shown a side view of a connector 20 incorporating features of an example embodiment. Although the features will be described with reference to the example embodiments shown in the drawings, it should be understood that features can be embodied in many alternate forms of embodiments. In addition, any suitable size, shape or type of elements or materials could be used.

Figure 3:
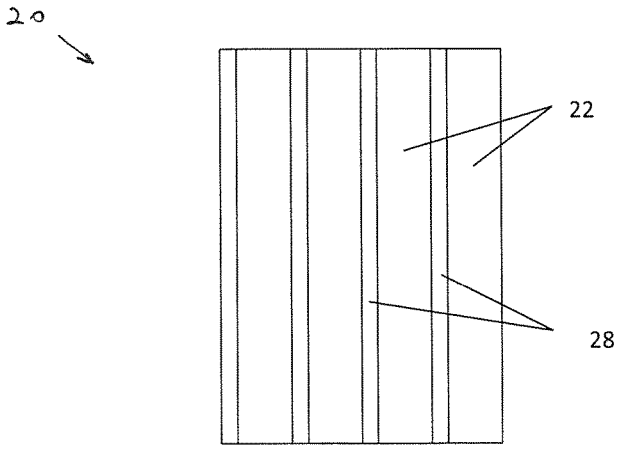
FIG. 3 is a side view of multiple insert molded lead frame assemblies.

The connector 20 is configured to connect the first circuit board 7 to the counterconnector 9. In this example the connector 20 comprises a plurality of insert molded leadframe assembly (IMLA) 22 stacked side-by-side. Each IMLA 22 comprises a housing section 24 and electrical contacts 26. The electrical contacts 26 comprise a plurality of differential pair signal contacts. In this example the housing section 24 is overmolded onto the contacts 26. FIG. 2 shows an example where the IMLA comprises four (4) differential pair of the signal contacts as illustrated by A, B, C and D. As schematically illustrated in FIG. 3, a ground conductor 28 is provided on each side of the IMLAs 22. However, in an alternate example a ground conductor might not be provided on each side of the IMLAs 22.

The connector 22 forms a stripline-like right-angle connector structure consisting of differential pairs in an IMLA with the groundplane 28 attached to the side of the IMLA. The connector uses "columnar-based signaling" meaning that both differential pair conductors 26*a*, 26*b* are located within the same vertical column (or IMLA) of the connector. Typically, because the two conductors cannot have the same physical length, there is inherent in-pair skew. Features as described herein may be used to prevent this skew by using a truly distributed skew correction throughout the entire transmission path. The skew may be controlled by the judicious placement of air holes in the IMLA plastic in the vicinity of the differential pair. The conductors 26*a*, 26*b* extend through an arc to traverse the right angle bend of the connector. For each given pair 26*a*, 26*b*, the shorter conductor 26*a* may be substantially completely encapsulated in plastic of the housing section 24. The longer conductor 26*b* of the pair has an elongated air gap 30 that spans the entire length of the arc. The width W of this air gaps 30A-30D are adjusted or selected to cancel or prevent in-pair skew from arising. This is essentially tuning of the effective dielectric constant of the longer conductor 26*b* such that its electrical length matches that of the shorter conductor.

Figure 4:
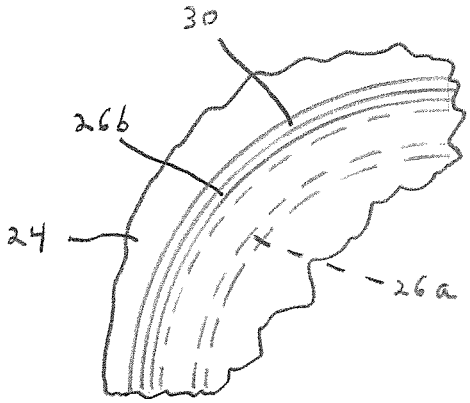
FIGS. 4 and 4A schematically show a shorter physical length contact completely covered by a housing section and a longer physical length contact only partially covered by the housing section exposed at an air gap.
Figure 4A:
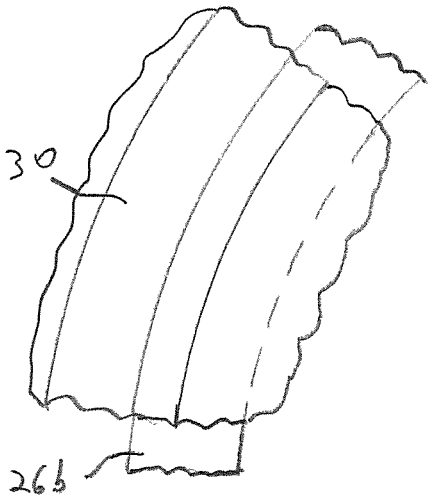

One feature in an example embodiment is to increase or decrease the width W of the air gap between the shorter conductor of a differential pair and the longer conductor of an adjacent differential pair to adjust skew. As seen in FIG. 2, the gaps 30A, 30B, 30C, 30D, starting at the bottom differential pair D and moving in a direction towards the differential pair A along the IMLA decrease in width and increase in arc length. FIGS. 4 and 4A schematically show the shorter physical length contact 26*a* completely covered by the housing section 24 and the longer physical length contact 26*b* only partially covered by the housing section 24; exposed at the air gap 30.

Figure 5:
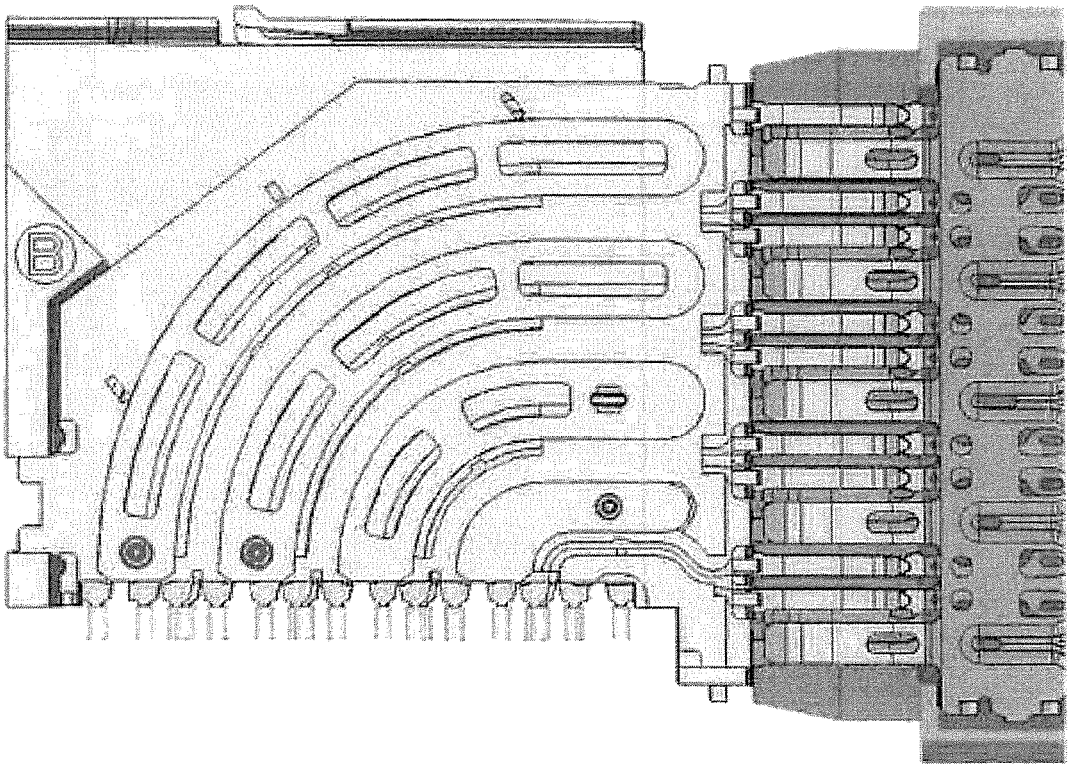
FIG. 5 a side view of a connector incorporating features of an alternate example embodiment.

FIG. 5 shows a side view similar to FIG. 2 of an alternate example.

A method may compensate for skew by changing a width of air or other electrical dielectric that is positioned immediately adjacent to one electrical conductor of a differential signal pair and a second electrical conductor of an immediately adjacent second conductor and between an adjacent second differential signal pair.

An example embodiment may be provided in an apparatus comprising a housing; and a first differential pair of signal contacts connected to the housing, where a first contact of the differential pair of signal contacts has a shorter physical length than a second contact of the differential pair of signal contacts, where a first air gap is provided in the housing at the second contact to thereby shorten an effective electrical length of the second contact and effectively reduce signal transmission in-pair skew between the first and second contacts.

The second contact may have a substantially arced section and the first air gap may have a substantially arced shape along at least part of the substantially arced section. The first contact may be substantially entirely encapsulated by the housing except at opposite end contact areas. The apparatus may comprise a second differential pair of signal contacts connected to the housing, where the first and second differential pair of signal contact are substantially aligned in a common plane, and where the second differential pair of signal contacts comprise: a third contact of the second differential pair of signal contacts having a shorter physical length than a fourth contact of the second differential pair of signal contacts, where a second air gap is provided in the housing at the fourth contact to thereby shorten an effective electrical length of the fourth contact and effectively reduce signal transmission in-pair skew between the third and fourth contacts. The second air gap may have a longer length and a shorter width than the first air gap. The third and fourth contacts may be longer than the first and second contacts, and where the first and second air gaps each have an arced shape. The apparatus may further comprise a ground electrical conductor connected to the housing, and where the apparatus is an insert molded leadframe assembly (IMLA). The first air gap may be located immediately adjacent a contact of a second differential pair of signal contacts of the apparatus and/or the ground electrical conductor. The apparatus may comprise a plurality of other differential pair of signal contacts, where one of the contacts in each of the plurality of other differential pair of signal contacts comprises its own respective air gap, where the air gaps each have a different length and width relative to one another.

An example method may comprise providing a first differential pair of signal contacts, where a first contact of the differential pair of signal contacts has a shorter physical length than a second contact of the differential pair of signal contacts; and molding a housing onto the differential pair of signal contacts, where a first air gap in the housing is formed at the second contact, where the first air gap is sized and shaped to thereby shorten an effective electrical length of the second contact and effectively reduce signal transmission in-pair skew between the first and second contacts.

The second contact may have a substantially arced section and the first air gap is formed with a substantially arced shape along at least part of the substantially arced section. The first contact may be substantially entirely encapsulated by the housing except at opposite end contact areas. The method may further comprise providing a second differential pair of signal contacts and molding the housing onto the second differential pair of signal contacts, where the first and second differential pair of signal contact are substantially aligned in a common plane, and where the second differential pair of signal contacts comprise: a third contact of the second differential pair of signal contacts having a shorter physical length than a fourth contact of the second differential pair of signal contacts, where a second air gap is provided in the housing at the fourth contact to thereby shorten an effective electrical length of the fourth contact and effectively reduce signal transmission in-pair skew between the third and fourth contacts. The second air gap may be formed with a longer length and a shorter width than the first air gap. The third and fourth contacts may be provided longer than the first and second contacts, and where the first and second air gaps each are formed with an arced shape. The method may further comprise connecting a ground electrical conductor to a side of the housing, and where the apparatus is an insert molded leadframe assembly (IMLA). The method may further comprise providing a plurality of other differential pair of signal contacts, where one of the contacts in each of the plurality of other differential pair of signal contacts comprises its own respective air gap, where the air gaps each have a different length and width relative to one another. In an alternate example, the first and second differential pair of signal contact might not be substantially aligned in a common plane.

An example method may comprise providing an electrical connector comprising a housing, at least two differential pair of signal contacts connected to the housing, and an electrical conductor connected to the housing, where a first one of the differential pair of signal contacts comprises a first contact having a shorter physical length than a second contact; and providing at least one different dielectric area in the housing along at least part of the length of the second contact, where the at least one different dielectric area is located immediately adjacent a contact of a second one of the differential pair of signal contacts and/or the electrical conductor.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising:

a housing;

a first differential pair of signal contacts connected to the housing, where a first contact of the first differential pair of signal contacts has a shorter physical length than a second contact of the first differential pair of signal contacts, where a first air gap having a first physical length and a first physical width is provided in the housing at the second contact to thereby shorten an effective electrical length of the second contact and effectively reduce signal transmission in-pair skew between the first and second contacts; and a second differential pair of signal contacts connected to the housing, where the first and second differential pair of signal contact are substantially aligned in a common plane, and where the second differential pair of signal contacts comprises:

a third contact and a fourth contact, wherein the third contact of the second differential pair of signal contacts having a shorter physical length than the fourth contact of the second differential pair of signal contacts, where a second air gap having a second physical length and a second physical width is provided in the housing at the fourth contact to thereby shorten an effective electrical length of the fourth contact and effectively reduce signal transmission in-pair skew between the third and fourth contacts;

wherein the first physical length is longer than the second physical length and the first physical width is narrower than the second physical width.

2. An apparatus as in claim 1 where the second contact has a substantially arced section and the first air gap has a substantially arced shape along at least part of the substantially arced section.

3. An apparatus as in claim 1 wherein the first contact is substantially entirely encapsulated by the housing except at opposite end contact areas.

4. An apparatus as in claim 1, where the third and fourth contacts are longer than the first and second contacts, and where the first and second air gaps each have an arced shape.

5. An apparatus as in claim 1, further comprising a ground electrical conductor connected to the housing, and where the apparatus is an insert molded leadframe assembly (IMLA).

6. An apparatus as in claim 1 where the apparatus comprises a plurality of other differential pair of signal contacts, where one of the contacts in each of the plurality of other differential pair of signal contacts comprises its own respective air gap, where the air gaps each have a different physical length and physical width relative to one another.

7. The apparatus of claim 1, wherein:

the apparatus comprises a plurality of differential pairs of signal contacts aligned in the common plane, including the first differential pair and the second differential pair, each of the plurality of differential pairs comprising a longer contact and a shorter contact;

the housing comprises a plurality of air gaps, including the first and second air gaps, at the longer contact of each of the plurality of differential pairs; and the plurality of air gaps have different physical lengths and physical widths.

8. An apparatus as in claim 5 where the first air gap is located immediately adjacent a contact of the second differential pair of signal contacts of the apparatus and/or the ground electrical conductor.

9. A method comprising:

providing a first differential pair of signal contacts, where a first contact of the differential pair of signal contacts has a shorter physical length than a second contact of the differential pair of signal contacts;

providing a second differential pair of signal contacts and molding the housing onto the second differential pair of signal contacts, where the first and second differential pair of signal contact are substantially aligned in a common plane, and where the second differential pair of signal contacts comprise:

a third contact of the second differential pair of signal contacts having a shorter physical length than a fourth contact of the second differential pair of signal contacts; and molding a housing onto the differential pair of signal contacts, where a first air gap in the housing having a first physical length and a first physical width is formed at the second contact, where the first air gap is sized and shaped to thereby shorten an effective electrical length of the second contact and effectively reduce signal transmission in-pair skew between the first and second contacts, where a second air gap having a second physical length and a second physical width is provided in the housing at the fourth contact to thereby shorten an effective electrical length of the fourth contact and effectively reduce signal transmission in-pair skew between the third and fourth contacts, where the second physical length is longer than the first physical length and the second physical width is narrower than the first physical width.

10. A method as in claim 9 where the second contact has a substantially arced section and the first air gap is formed with a substantially arced shape along at least part of the substantially arced section.

11. A method as in as in claim 9, where the first contact is substantially entirely encapsulated by the housing except at opposite end contact areas.

12. A method as in claim 9 where the third and fourth contacts are provided longer than the first and second contacts, and where the first and second air gaps each are formed with an arced shape.

13. A method as claim 9, further comprising connecting a ground electrical conductor to a side of the housing, and where the apparatus is an insert molded leadframe assembly (IMLA).

14. A method as in claim 13 further comprising providing a plurality of other differential pair of signal contacts, where one of the contacts in each of the plurality of other differential pair of signal contacts comprises its own respective air gap, where the air gaps each have a different physical length and physical width relative to one another.

15. A method comprising:

providing an electrical connector comprising a housing, a plurality of differential pair of signal contacts connected to the housing, and an electrical conductor connected to the housing, where each of the differential pair of signal contacts comprises a first contact having a shorter physical length than a second contact; and providing, for each of the plurality of differential pairs of signal contacts, at least one different dielectric area in the housing along at least part of the length of the second contact, where the at least one different dielectric area is located immediately adjacent the second contact of the differential pair of signal contacts and/or the electrical conductor, wherein the at least one different dielectric areas associated with the plurality of differential pairs have different physical widths and different physical lengths.

16. The method of claim 15, wherein:

areas of the at least one different dielectric areas with shorter physical lengths than others of the at least one different dielectric areas have wider physical widths than the others of the at least one different dielectric areas.

17. An apparatus comprising:

a housing;

a plurality of differential pairs of signal contacts aligned in the common plane, each of the plurality of differential pairs comprising a physically longer contact and a physically shorter contact; and a plurality of air gaps in the housing at the longer contact of each of the plurality of differential pairs to thereby shorten an effective electrical length of the physically longer contact and reduce signal transmission in-pair skew between the physically longer and physically shorter contacts;

wherein:

the plurality of air gaps have different lengths and widths; and the air gaps with longer lengths than others of the air gaps have shorter widths than the others of the air gaps.

18. An apparatus comprising:

a housing;

a plurality of differential pairs of signal contacts aligned in the common plane, each of the plurality of differential pairs comprising a physically longer contact and a physically shorter contact; and a plurality of air gaps in the housing at the longer contact of each of the plurality of differential pairs to thereby shorten an effective electrical length of the physically longer contact and reduce signal transmission in-pair skew between the physically longer and physically shorter contacts;

wherein:

the plurality of air gaps have different lengths and widths; and the plurality of differential pairs bend through a right angle and comprise a column of signal contacts in a right angle connector;

the column has a plurality of rows of signal contacts of differing length; and each air gap of the plurality of air gaps at a respective contact has a shorter width than others of air gaps of the plurality of air gaps at contacts that are shorter than the respective contact.

19. The apparatus of claim 18, wherein:

each air gap of the plurality of air gaps at a respective contact has a longer length than others of air gaps of the plurality of air gaps at contacts that are shorter than the respective contact.

* * * * *